US006079247A

United States Patent [19]

Gravier

[11] Patent Number: 6,079,247

[45] Date of Patent: Jun. 27, 2000

[54] SHEET METAL BENDING MACHINE WITH OFFSET PRESS ROLLERS

[75] Inventor: Michel Gravier, Nezel, France

[73] Assignee: Jammes Industrie, S.A., Cebazat, France

[21] Appl. No.: 09/194,630

[22] PCT Filed: Mar. 28, 1997

[86] PCT No.: PCT/FR97/00563

§ 371 Date: Nov. 27, 1998

§ 102(e) Date: Nov. 27, 1998

[87] PCT Pub. No.: WO97/46336

PCT Pub. Date: Dec. 11, 1997

[30] Foreign Application Priority Data

Jun. 6, 1996 [FR] France ..... 96 07375

[51] Int. Cl.[7] ..... B21D 5/14

[52] U.S. Cl. ..... 72/175

[58] Field of Search ..... 72/170, 173–175

[56] References Cited

U.S. PATENT DOCUMENTS

| | | | |
|---|---|---|---|
| 4,056,962 | 11/1977 | Gerhardt | 72/170 |
| 4,706,488 | 11/1987 | Williamson | 72/175 |
| 4,977,770 | 12/1990 | Gravier | 72/175 |

FOREIGN PATENT DOCUMENTS

| | | | |
|---|---|---|---|
| 974789 | 2/1951 | France . | |
| 2528334 | 12/1983 | France . | |
| 2528335 | 12/1983 | France . | |
| 2637206 | 4/1990 | France . | |
| 420013 | 10/1925 | Germany . | |
| 118924 | 5/1991 | Japan | 72/170 |
| 3142 | of 1895 | United Kingdom | 72/173 |

*Primary Examiner*—Daniel C. Crane
*Attorney, Agent, or Firm*—Horst M. Kasper

[57] ABSTRACT

The invention features a sheet metal bending machine constituted by a smooth carrying roller around which the sheet metal is rolled, after bending, and by smooth press rollers against which the carrying roller presses, is characterized in that the carrying roller (2) is supported at one end by a fixed bearing (15) and at its other end by a retractable bearing (18), and in that the press rollers (3, 4) are supported, directly or indirectly (support rollers) by a plurality of bearings (5) supported by a control mechanism called "inclined blocks". (7, 8).

20 Claims, 5 Drawing Sheets

SHEET METAL BENDING MACHINE WITH OFFSET PRESS ROLLERS

BACKGROUND OF THE INVENTION

This invention falls within the domain of working with sheets of material, such as sheets of metal, with a view to bending them, more specifically the object of the invention is a machine, called a "bending machine", designed to bend the sheets of metal.

Patent FR-974.789 (BIGWOOD° describes a bending machine for sheet metal with a pivoting upper support roller and a retractable bearing; however a machine like this uses a complex mechanism for adjusting the radius of the bend by means of a motor driven screw.

The Applicant's patent FR-2.528.334 describes a bending machine with a pivoting support roller, and in this respect it is similar to the above mentioned device, this pivoting support roller is situated above a pair of two smooth rollers with a smaller diameter, called pressers, parallel to each other and able to be moved away from each other in order to produce different bending radii; the performance of these machines was not as good as that of the preceding machines but they were cheaper and were suitable for boiler making concerns where the bending constituted only one part of the job. The present invention relates specifically to rollers like these.

Patents FR-2.528.335 and FR-2.637.206 belonging to the same Applicant describe bending machines said to have toothed rollers consisting of a big roller called a support roller and two sets of numerous rollers called pressers with sufficiently small diameter relative to that of the support roller and interlocking with each other so that they are able to have lines of contact with the support roller, closer than those permitted by full rollers, in order to increase the accuracy of the bending and to reduce to a minimum the parts remaining straight at the extremities of the sheet on entry to and exit from the bending operation; in this type of machine the toothed rollers, situated above the big roller, are grouped in two parallel trains of rollers each train itself being composed of several coaxial rollers; in certain machines of this type, determination of the bending radius is carried out by varying the distance between the presser rollers (toothed) and the support roller, using an inclined plane device (sloped cams and wedges) which can be moved by sliding one against another by means of a crank with a gravitational indicator dial. These machines, with high productivity and great ease of handling, are generally used by specialist concerns in the series production of ferrules (sheets of metal bent and welded).

These machines have a common characteristic in that the presser and support rollers always remain parallel; however in the case of thin sheets (for example thinner than 2 millimeters) or of soft material (for example aluminium) they have the disadvantage of "marking" the sheet as a result of the toothed nature of the presser rollers.

The aim of the present invention is to make a bending machine available to non-specialist concerns which will permit the bending of quite large sheets, that are not very thick, and/or made of a material that is not very hard.

SUMMARY OF THE INVENTION

According to the present invention a machine for bending sheets, called a bending machine, of the type of bending machine consisting principally of a roller, called a support roller, around which the sheet is to be rolled after bending, and smooth rollers, called pressers, designed to press against the support roller is characterised in general in that the support roller around which the sheet is rolled after bending, is connected at a first extremity to a motor and is supported at this first extremity by a fixed bearing, and at its other extremity by a retractable (swivel) bearing, the axis of this support roller remaining fixed, and in that the presser rollers are smooth rollers arranged in pairs with a fixed distance between axes and supported by a number of bearings, or rollers, themselves supported by a beam which rests on the frame by means of inclined wedges It is therefore in the new combination of known means, and in the establishment of the effectiveness of such a combination, for the purpose of achieving a result, namely the bending of soft and/or thin sheets, with the facility of making rapid and accurate changes to the bending radius, that the inventive nature must be sought, rather than in the novelty of the means taken independently.

The fixed axis support roller is preferably placed above the assembly of presser rollers so that the presser rollers can be moved vertically up and down by the inclined wedges when they are pressed against the sheet that is to be bent, and down as a result of their weight after the bending operation.

The result of this arrangement is that the bending radius can be controlled simply by reading the marking on the gravitational indicator dial for the means of adjustment and that, in general, passing the sheet only once between the rollers is sufficient to bend it to the desired extent, it will, however, be noted that the operator will always have the choice between bending the sheet in one passage between the rollers or several, bearing in mind that it is the bending machine that will determine the accuracy of the bending and not the operator.

At this stage of the definition of the invention it will be noticed that there are two difficulties to be resolved: one relates to the flexibility of the presser rollers, the other to the flexibility of the support roller.

The first lies in the fact that, because the lines of contact of the presser rollers with the support roller can be quite close to each other, relative to the size of the diameters of the presser rollers, so that a sheet introduced between the first presser roller and the support roller, comes into oblique contact with the upper segment of the second presser roller, it is necessary that the diameter of the presser rollers be much smaller (about ⅓) than the diameter of the support roller, and that these rollers be as close as possible to each other; now considering that the resistance of a cylindrical beam to sagging varies roughly by the fourth power ($D^4$) of its diameter, their small diameter will result in great flexibility, in practice unacceptable flexibility, of the presser rollers.

In order to define the ideas raised above, more accurately, by "as close as possible" there is meant the fact that the distance between their axes e lies between d and 1,5d, d being the diameter, preferably the same for each one, of the presser rollers, d itself lying between 0,2xDand 0,5xD, D being the diameter of the support roller the effective length of D lying between 5xD and 10xD, the smallest bending diameter that can be achieved with a machine as defined being between about 1,2 and 1,4xD: it will be noted that the choice of these dimension ratios also enhances the invention because of the innumerable theoretic possibilities which it offers a great number of which prove to be inappropriate in practice, which only an intuitive judgement based on wide experience can eliminate a priori.

One solution proposed by the invention to solve the problem of the sagging of the presser rollers, consisted of dividing the presser rollers into sections, each section being supported in rotation at its extremities, by a support component, the support components themselves resting on a beam, preferably and I-beam, called intermediate, itself supported indirectly on the general frame of the machine.

However, because the rollers are in sections, the problem of "marking" of the sheets by the extremity edges of the sections, remained to be solved; this problem was resolved by wedging the sections in the axial direction, so that the extremity edge of one section of a presser roller is always opposite a cylindrical part of a section of the other roller, excepting for the extremities of the rollers themselves; the withdrawing wedge chosen is only slightly bigger than the thickness of the support components, this thickness is reduced to a minimum by the judicious choice of the suspension of the sections, and as a result of the Z-configuration of the support components; with the result that even very thin sheets can be bent without being marked.

All that remains to be resolved for a machine like this is the problem of sagging, albeit only slight, in the support roller, and also that of determining the bending radius; a solution that has already been applied in another type of machine (cf: FR-2.637.206, FIG. 6 and 7)), has been adapted to the bending machine of the invention, namely the insertion between the non-flexible general frame and the beam supporting the presser rollers of a mechanism with a "ramp of cams" and with "sloped wedges", the surfaces in contact with the cams and sloped wedges being planes which with the plane of the axes of the presser rollers, form dihedral angles with their crests oblique relative to these axes; it will be recalled that it is the slope of the wedges and their transverse displacement that permits compensatory adjustment of the sagging of the support roller; in the new application which has been carried out, the mechanism is inserted under the presser rollers, between the beam which supports these rollers and the frame.

The assembly of these combined arrangements, namely presser rollers with reduced distance between the axes, adjustment of the bending radius by means of a ramp of cams and sloped wedges, and adjustable stop with graduated dial, permits accurate adjustment by an unqualified operator, and bending achieved in a single passage through the rollers resulting in high productivity.

A second solution proposed by the invention more particularly adapted to bending with a small radius, but always bearing in mind the problem of sagging, consisted of adding a second stage of rollers with small diameters to the presser rollers divided into sections supported in rotation, these second stage rollers with small diameter positioned above the preceding presser rollers and also supported by the same Z-configured support components.

Finally a third solution proposed by the invention, more particularly adapted to bending thin and fragile sheets (thickness <0.6 mm), the second stage rollers are continuous over the whole width of the passage of the sheets, and rest either on sectioned rollers with Z-shaped support components, or more simply on wheels distributed over the width of the passage and supported by ordinary support components.

It must therefore be understood that the bending machine of the invention is represented as the assembly resulting from the combination of permanent characteristics of the support roller and its components of compensation for sagging, feeding and maintaining, and means for manoeuvring the presser rollers, and alternative characteristics roughly three in number, of actual presser rollers and their means of support

BRIEF DESCRIPTION OF THE DRAWINGS

The present invention will be better understood, and the improvements will appear from the description which will be made of the solutions proposed by the invention, with reference to the attached plates and figures in which.

DETAILED DESCRIPTION OF THE PREFERRED EMBODIMENT

Figure 1:
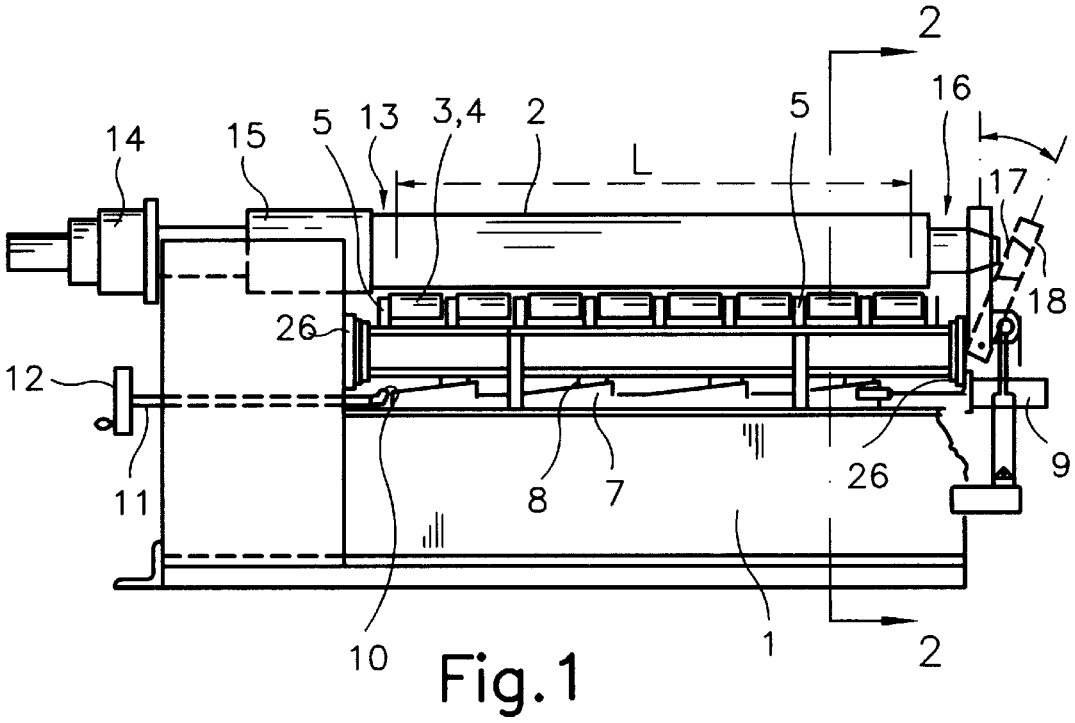
FIG. 1 is a side elevation of a bending machine according to the invention including, as an example of this, the first and second characteristics, these characteristics being an improvement on the first solution for presser rollers.

In FIGS. 1 and or 2, a bending machine according to the invention is principally made up of a frame consisting of a massive I-shaped frame-beam 1, an upper roller with large diameter D, called support roller 2, in the direction of which two sets 3, 4 of rollers with small diameters, called presser rollers, can be drawn upwards, each of these sets consisting of several roller sections; the presser rollers are supported by means of support components such as 5 by an I-beam called intermediate beam 6.

The intermediate beam 6 can be moved vertically, between the extremity guides 26, by a manoeuvring device of the ramp type 7 with inclined cams and wedges 8 supported by the frame beam 1; the ramp 7 is moved horizontally by a couple of jacks such as 9; adjustment of the amplitude of vertical displacement of the support beam thus the space between the presser rollers and the support roller, space which determines the bending radius, is achieved by horizontal displacement of a stop 10, by means of a manually rotated screw 11 with a gravitational indicator dial 12.

Figure 2:
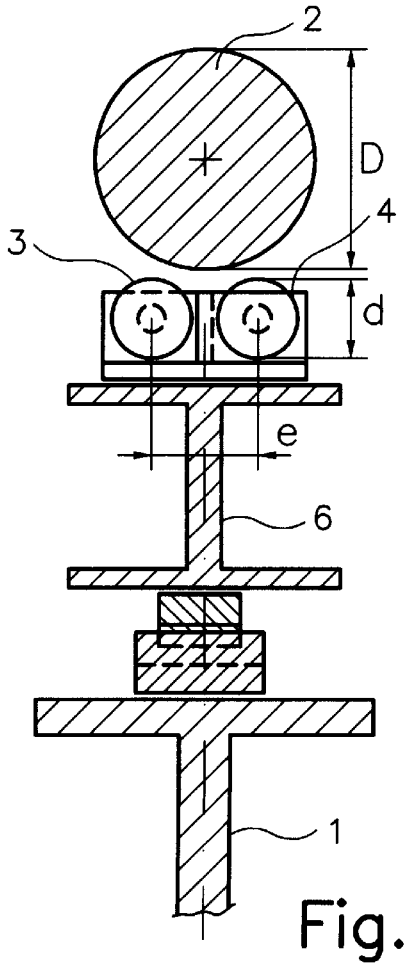
FIG. 2 is a section along AA of the bending machine shown in the preceding figure, illustrating on a larger scale the arrangement and dimensional ratios of the various rollers.

The support roller 2 is supported at a first extremity 13, from where it is rotated by an hydraulic motor 14, by a very robust first bearing 15 two diameters in length, and at its other extremity 16 by a retractable bearing 17 fitted into a swivel component called a "side gate" 18; this arrangement permits axial retraction of the sheets after bending With reference to FIGS. 1 or 2, the following dimensional sizes are fixed d: diameter of the presser rollers (113 mm)

e: distance between the axes of the presser rollers (120 mm),

D: diameter of the support roller (310 mm),

L: efficient length of the support roller (2080 mm);

it will be noted that the dimensions given between brackets are those of a particular bending machine, that they correspond with the ratios defined above, and that they should in no way be considered to limit the scope of the invention.

Figures 3, 4:
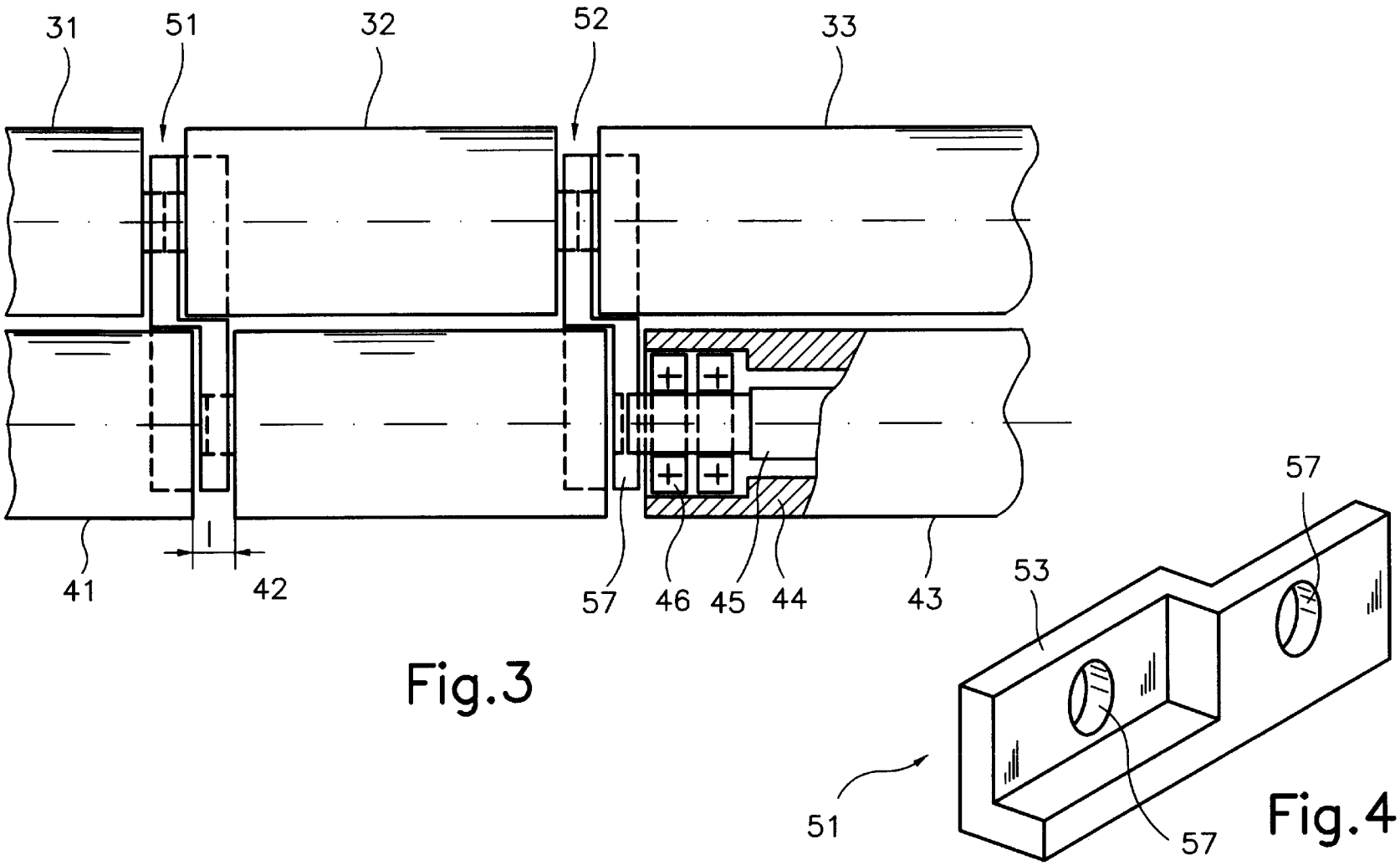
FIG. 3 is a plan drawing on a larger scale of the constructive arrangement of the presser rollers and their support components.
FIG. 4 is a perspective drawing of a bearing from the preceding figure.

In FIGS. 3 and 4, the presser rollers each consist of numerous sections 31, 32, 33 . . . of equal length, and it will be noted that neighbouring extremities of four adjacent sections are supported by one common support component, such as 51, consisting of a thin Z-shaped partition 53 forming with the sole 54 a corner piece, this arrangement confers a particularly high rigidity on the support component, which allows the partition to be of the desired thinness and permits two adjacent extremities of two sections of the same roller to be as close to each other as possible and thus only to have to unwedge two opposite rollers, for example 31 and 41, for a minimal distance 1.

Because of the thinness of the partition which does not allow for the creation of bearings for supporting rotation of a hub, the roller sections are each made of a hollow cylinder, such as 44 shown in section, mounted to rotate on a coaxial central shaft 45 by bearings such as 46 situated in the vicinity of each of the extremities of the section; the shaft itself being engaged securely in a hole 57 reamed out from the adjacent partition 53 of a support component 5 (FIG. 4); each reamed out hole, excepting for those of the extremity support components of the rollers thus supports two neighbouring coaxial shafts.

Figure 5:
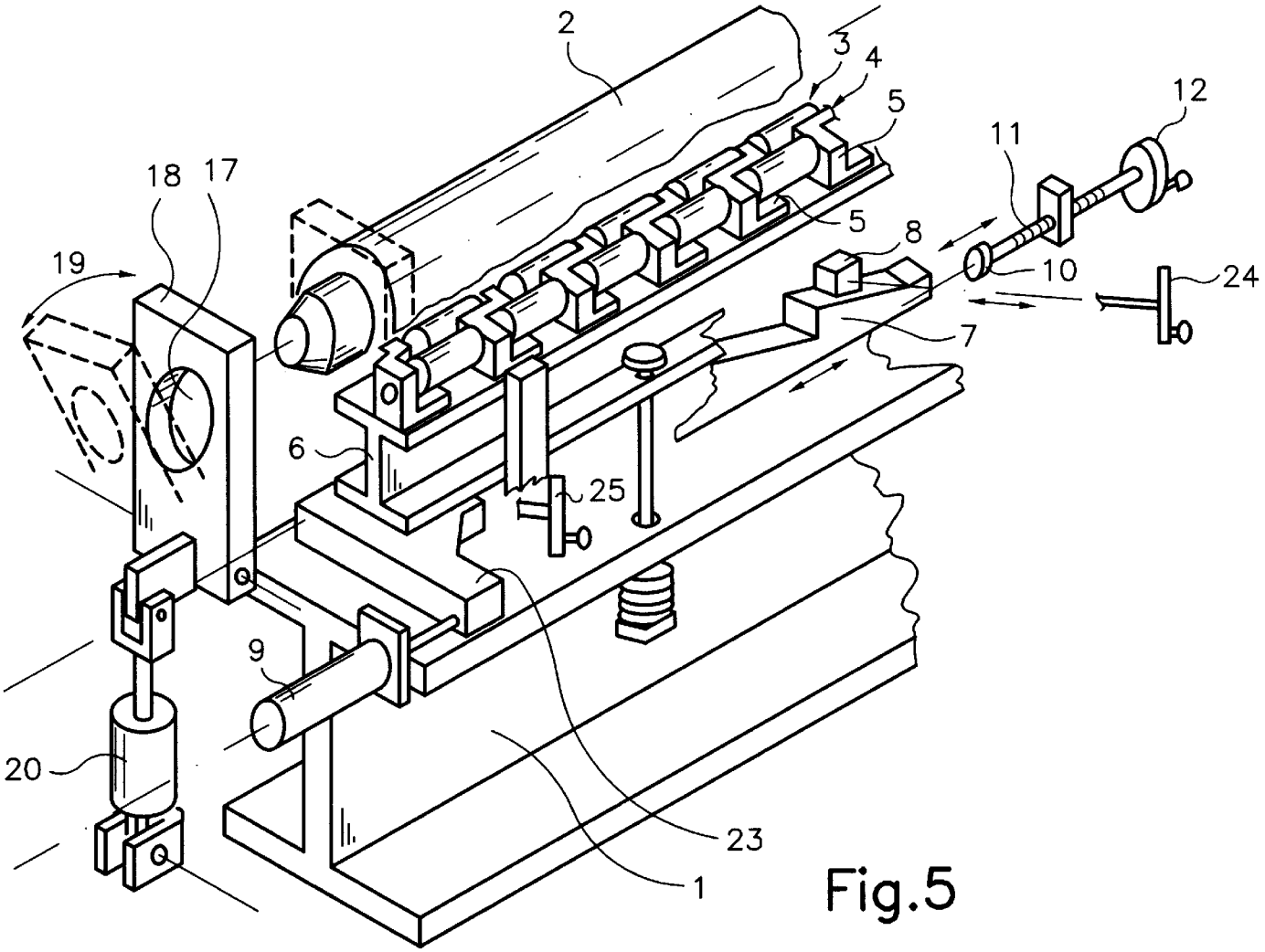
FIG. 5 is a partial view in exposed perspective of the bending machine shown in FIG. 1.

In FIG. 5, certain components from the preceding figures are show again with the same reference numbers; it will be noted moreover that the inclined wedges such as 8 can be moved obliquely relative to the cam ramp 7 and the intermediate beam 6 which supports them by means of an oblique stand that has a slide (see FIG. 6 of the patent mentioned above), cranks of gravitational indicator dials with cranks such as 24 and 25, analogous to the crank 12 mentioned above, which each permit displacement of the respective inclined wedge, such as 8, to which it is connected, so that the sagging of the support roller can be compensated for depending on the thickness or the nature of the sheet to be bent.

The ramp 7 itself can be moved by pushing with a couple of hydraulic jacks such as 9 using a transverse component called a "stirrup" 23, to which the ramp is connected.

The side gate 18 with bearing 17 is articulated on to the frame 1 so that it can swivel (arrow 19) when subjected to the effects of a jack 20 between a vertical position in which the bearing 17 fits on to the conical extremity 16, of the support roller 2, and a horizontal position (not shown) in which the extremity of the roller is free so that the bent sheet can be extracted. It will be noted that the conical shape, even rounded shape of the extremity 16 of the support roller, permits the axis of this support roller to remain fixed while the side gate is moved, even while the bent sheet is being extracted.

The jack 20 for the side gate, the jacks 9 for moving the ramp 7 and the hydraulic motor 14 for driving the support roller 2 are supplied with pressurised fluid by a common hydraulic centre not shown but which is advantageously secured close to the extremity of the general frame where the motor is.

Thus as a result of the means of adjustment consisting principally of the gravitational dials, the operator, who needs no particular qualification, has only to set the various adjustments from an empirically established table, to achieve the desired bending.

It will be noted that, still within the scope of the invention, the hydraulic motor can be replaced by a simple electric reduction motor or by an electric motor with a "brushless" type of axle, and the hydraulic jacks by ball screws and axle motor; it may also be noted that the manual manoeuvring device for the means of adjustment can be replaced by an assembly that is under numeric control so that the bending radius can be varied in a programmed fashion while a single sheet is passing through the bending machine, and in this way a ferrule is finally achieved that is oval, elliptical or polygonal with rounded angles.

Figure 6:
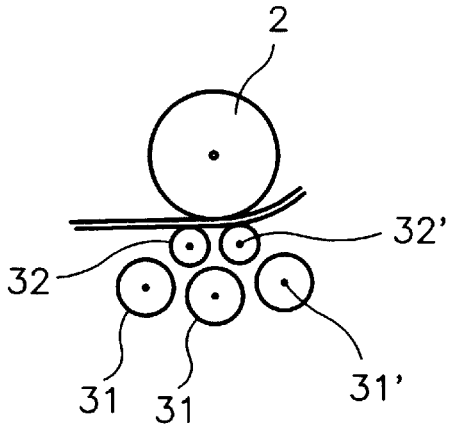
FIG. 6 is a diagram of a transverse section of a bending machine featuring the second solution for the presser rollers.

In FIG. 6, a roller illustrating the second solution is shown, having a lower stage of rollers such as 31, with axes 31', there are three of them and they serve as support for the two presser rollers 32, with axes 32', with small diameter and quite close to each other, which are situated above them.

Figure 7:
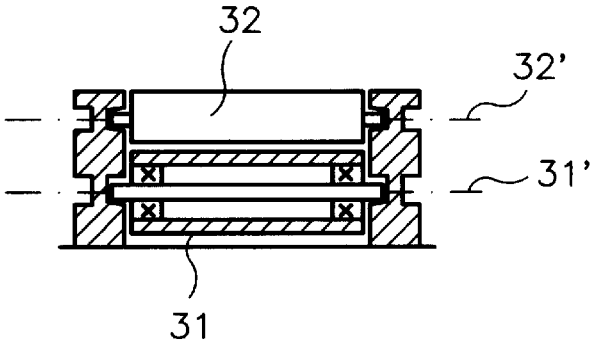
FIG. 7 is a section along AA of the preceding figure
Figure 8:
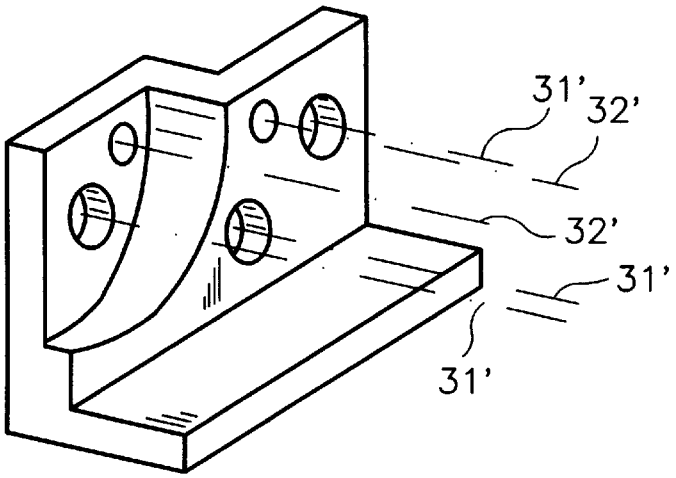
FIG. 8 is a perspective drawing of a bearing from the preceding figure.

From FIG. 7 it can be seen that a roller 32 from the preceding figure is a solid roller while a support roller 31 is mounted on ball bearings on a fixed axle 33; the rollers 31 and 32 are supported by Z-shaped support components such as the component in FIG. 8, analogous to that of FIG. 4, showing the axes 31' and 32' of the rollers.

FIG. 7 shows clearly that the rollers, both pressers 32 and support 31, of the bending machine shown in FIGS. 6 to 8 are discontinuous sections.

Figure 9:
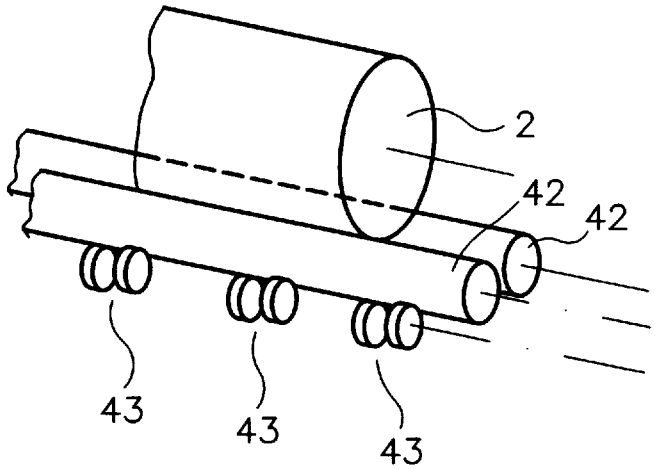
FIG. 9 is a simplified perspective drawing of the rollers of a bending machine featuring the third solution for the presser rollers.
Figure 10:
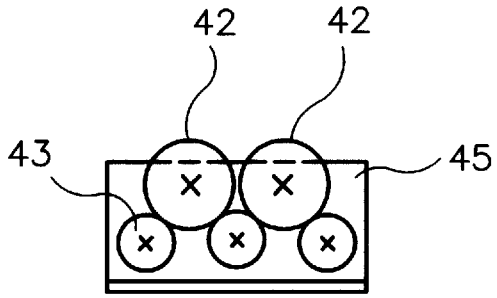
FIGS. 10 and 11 show, seen end on, the presser rollers of the preceding figure with their supporting wheels and their extremity support components FIG. 10) and intermediate support components (FIG. 11)
Figure 11:
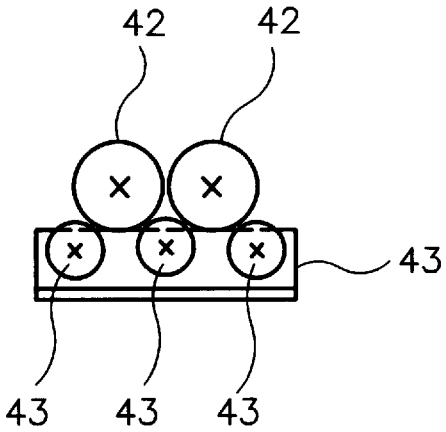
Figure 12:
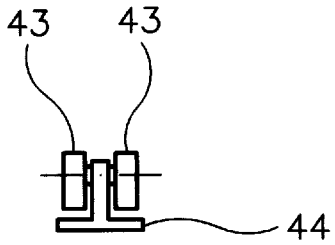
FIG. 12 shows, in a direction perpendicular to that of the preceding figures, how the support wheels fit on to their support component.

In FIG. 9, the presser rollers 42, according to the third solution, and as opposed to those of the preceding figures, are continuous, that is they extend over the entire width of the passage of the sheets, along the length of the bending machine; the rollers 42 are supported at intervals by pairs of wheels such as 43 positioned every so often along an intermediate support component such as 44, or on one side of an extremity support component such as 45.

Finally it will be noted that the machine can have means for automatic variation of the bending radius during the rolling operation, and so produce ferrules (bent sheets) with noncircular profiles (for example elliptical, triangular with rounded angles, etc. . . . ).

What is claimed is:

1. Machine for bending metal sheets, called a bending machine, of the type of bending machine which consists principally of roll, called a support roll (2), in an upper position, the support roll comprising an axis and a first end (13) and a second end (16), said support roll around which the sheet is to be rolled after bending, said support roll being, supported at its second end (16), by a retractable bearing (17) so that the rolled sheet can he extracted by moving it along the axis of the support roll and of lower rolls, called presser rolls (3,4) intended to press the sheet against the support roll, the support roll (2) around which the sheet is rolled after bending, being connected, at its first end (13), to a motor (14) and being supported at this first end by a fixed bearing (15), the axis of the support roll remaining fixed, characterized:

in that the presser rolls (3,4) are arranged in pairs with fixed distances (e) between their axes and are supported by numerous bearings (5), or rolls (31), themselves supported by a beam (6) which itself rests on the frame (1) via a manoeuvring device with a ramp of cams (7) and "sloped wedges" (8).

2. Bending machine according to claim 1, characterized:

in that the presser rolls (3, 4, 32) are divided into sections (31, 32, 33, . . . ), each section being supported for rotation, at its ends, by a support component (5, 51, 52, . . . ), the support components themselves resting on the intermediate beam (6), and in that the sections (31, 32, 33) of one roll are offset relative to those (41, 42, 43) of the other roll in the axial direction, and are supported by support components (51) consisting of a Z-shaped thin partition (53) forming an angle-bracket-shaped assembly with a sole (54), so that the end edge of one section of a presser roll is always opposite a cylindrical part of a section of the other roll, except for the ends of the rolls themselves.

3. Bending machine according to claim 2, characterized:

by a second stage of presser rolls (32) of small diameter positioned above rolls or wheels.

4. Bending machine according to claim 3, characterized:

in that the rolls of the second stage are sections themselves also supported by the same Z-shaped support components (51).

5. Bending machine according to claim 3, characterized:

in that the rolls (42) of the second stage are continuous over the entire sheet passage width.

6. Bending machine according to claim 5, characterized:

in that the rolls of the second stage rest on sectioned rolls with Z-shaped support components (51).

7. Bending machine according to claim 5, characterized:

in that the rolls of the second stage rest on wheels (43) distributed over the passage width and supported by ordinary support components (44).

8. Bending machine according to either one of claims 2 and 3, characterized:

in that the distance e between the axes of the presser rolls (3, 4) is between d and 1.5d, d being their diameter, preferably identical for each one, d itself being between 0.2D and 0.5D, D being the diameter of the support roll (2), the effective length L of the latter itself being between 5D and 10D.

9. Bending machine according to claim 8, characterized:

in that the sections of the roll each consist of a hollow cylinder (44) mounted so as to rotate on a coaxial central shaft (45) via rolling bearings (46) positioned in the vicinity of each of the ends of the section, the shaft itself being engaged securely in an open bore (57) in the adjacent partition (53) of a support component (5), each bore, except for those in the support components for the ends of the rolls, supporting two neighbouring coaxial shafts.

10. Bending machine according to claim 1, characterized:

in that the support roll is supported at a first end (13) by a double-length first bearing (15) and at its other end (16) by a retractable bearing (17) made in a tiltable component (18) called a gate, and in that the gate (18) with the bearing (17) is articulated to the frame (1) so that it can tilt (arrow 19), under the effect of a jack (20), between a vertical position, in which the bearing (17) fits snugly on a tapered end (16) of the support roll (2), and a horizontal position in which the end of the roll is free so that the bent sheet can be extracted.

11. A machine for bending metal sheets comprising a frame (1);

a support roll (2) including an axis, a first end (13), a second end (16), and disposed in an upper position, wherein a sheet having been bent is to be rolled around the support roll;

a fixed bearing (15) disposed on the frame and supporting the first end of the support roll, wherein the fixed bearing (15) retains the axis of the support roll in a fixed position;

a maneuvering device having a ramp of cams (7) and "sloped wedges" (8) and disposed on the frame (1);

a beam (6), wherein the beam (6) rests on the manoeuvring device having a ramp of cams (7) and "sloped wedges" (8);

a plurality of members selected of the group consisting of pressure bearings (5) and bearing rolls (31), wherein individual ones of the plurality of members selected of the group consisting of pressure bearings (5) and bearing rolls (31) are supported by the beam (6);

a plurality of pressure rolls (3, 4) disposed below the support roll, wherein individual rolls of the plurality of pressure rolls each have an axis and are aligned with the axes disposed in parallel positions, and wherein individual ones of the plurality of pressure rolls (3,4) are disposed in pairs having fixed distances (e) between their axes, wherein individual ones of the plurality of pressure rolls (3,4) are supported by individual ones of the plurality of members selected of the group consisting of pressure bearings (5) and bearing rolls (31);

a retractable bearing (17) supporting the support roll at the second end (16) of the support roll for extracting the rolled sheet by moving the rolled sheet along the axis of the support roll and along the axis of the plurality of pressure rolls for pressing the sheet against the support roll;

a motor (14), wherein the motor (14) is connected to the first end (13) of the support roll (2), around which the bent sheet is rolled.

12. The bending machine according to claim 11 wherein the pressure rolls (3, 4, 32) are subdivided into sections (31, 32, 33, . . . ), wherein each one of the sections is supported at its ends, by a support component (5, 51, 52, . . . ) for allowing rotation, and wherein the support components themselves resting on the beam (6);

wherein the sections (31, 32, 33) of one roll are offset relative to those sections (41, 42, 43) of the other roll in the axial direction, and wherein the sections are supported by support components (51) consisting of a Z-shaped thin partition (53) forming an angle-bracket-shaped assembly with a sole (54), whereby the end edge of one section of a pressure roll is always opposite a cylindrical part of a section of the other roll, except for the ends of the rolls themselves.

13. The bending machine according to claim 12 further comprising a second stage of pressure rolls (32) of small diameter positioned above rolls or wheels.

14. The bending machine according to claim 13, wherein the rolls of the second stage are sections which in turn are also supported by the same Z-shaped support components (51).

15. The bending machine according to claim 13, wherein the rolls (42) of the second stage are continuous over the entire sheet passage width.

16. The bending machine according to claim 15, wherein the rolls of the second stage rest on sectioned rolls with Z-shaped support components (51).

17. The bending machine according to claim 15, wherein the rolls of the second stage rest on wheels (43) distributed over the passage width and supported by ordinary support components (44).

18. The bending machine according to claims 12, wherein the distance e between the axes of the pressure rolls (3, 4) is between d and 1.5d, wherein d is the diameter of the pressure rolls, wherein d has a value of between about 0.2D and 0.5D, wherein D is the diameter of the support roll (2), and wherein the effective length L of the support roll (2) is between 5D and 10D.

19. The bending machine according to claim 18, wherein each of the sections of the roll consists of a hollow cylinder (44) mounted allowing for rotating on a coaxial central shaft (45) via roller bearings (46) positioned in the vicinity of each of the ends of the section, wherein the shaft itself is engaged securely in an open bore (57) in the adjacent partition (53) of a support component (5), wherein each bore, except for those bores in the support components for the ends of the rolls, is supporting two neighboring coaxial shafts.

20. The bending machine according to claim 11, wherein the support roll is supported at the first end (13) by a double-length first bearing (15) and at the second end (16) by the retractable bearing (17) made in a tiltable component furnished by a gate (18), and wherein the gate (18) with the bearing (17) is articulated to the frame (1) so that it can tilt (arrow 19), under the effect of a jack (20), between a vertical position, in which the bearing (17) fits snugly on a tapered end (16) of the support roll (2), and a horizontal position in which the end of the roll is free so that the bent sheet can be extracted.

* * * * *